US007310656B1

(12) United States Patent
Gilbert

(10) Patent No.: US 7,310,656 B1
(45) Date of Patent: Dec. 18, 2007

(54) GROUNDED EMITTER LOGARITHMIC CIRCUIT

(75) Inventor: Barrie Gilbert, Portland, OR (US)

(73) Assignee: Analog Devices, Inc., Norwood, MA (US)

( * ) Notice: Subject to any disclaimer, the term of this patent is extended or adjusted under 35 U.S.C. 154(b) by 686 days.

(21) Appl. No.: 10/316,990

(22) Filed: Dec. 10, 2002

Related U.S. Application Data

(60) Provisional application No. 60/430,465, filed on Dec. 2, 2002.

(51) Int. Cl.
*G06G 7/26* (2006.01)

(52) U.S. Cl. ..... 708/851

(58) Field of Classification Search ..... 708/851
See application file for complete search history.

(56) References Cited

U.S. PATENT DOCUMENTS

| | | | | |
|---|---|---|---|---|
| 3,689,752 | A | 9/1972 | Gilbert | |
| 4,075,574 | A * | 2/1978 | Gilbert | 330/257 |
| 4,122,528 | A * | 10/1978 | Rieger | 708/823 |
| 4,604,532 | A | 8/1986 | Gilbert | |
| 5,195,827 | A * | 3/1993 | Audy et al. | 374/172 |
| 5,345,185 | A * | 9/1994 | Gilbert | 327/350 |
| 5,489,868 | A * | 2/1996 | Gilbert | 327/351 |
| 5,570,055 | A * | 10/1996 | Gilbert | 327/350 |
| 6,144,244 | A * | 11/2000 | Gilbert | 327/350 |
| 6,437,630 | B1 | 8/2002 | Gilbert | |
| 6,822,433 | B1 * | 11/2004 | Gilbert | 324/76.77 |
| 2005/0110479 | A1 * | 5/2005 | Gilbert | 324/76.77 |

OTHER PUBLICATIONS

"Multiplication and Logarithmic Conversion by Operational Amplifier-Transistor Circuits" article by William L. Paterson, published Dec. 1963, vol. 34, No. 12 of *The Review of Scientific Instruments*, cover sheet and pp. 1311-1316.
"Monolithic Logarithmic Amplifiers" article by Barrie Gilbert, published 1994, pp. 1-122.
"Translinear Circuits: An Historical Overview" article by Barrie Gilbert, published 1996, Analog Integrated Circuits and Signal Processing, pp. 95-118.
Definition of "maintain", *The American Heritage®, Dictionary of the English Language, Third Edition* , copyright 1992 by Houghton Mifflin Company.

* cited by examiner

*Primary Examiner*—Tan V. Mai
(74) *Attorney, Agent, or Firm*—Marger Johnson & McCollom, PC

(57) ABSTRACT

A logarithmically-responding circuit includes a differential-input amplifier that drives the control terminal of a three-terminal device that exhibits an exponential response in its output current. This arrangement allows the third terminal to be grounded. In a preferred embodiment the three-terminal device is a bipolar junction transistor (BJT). This, and other supporting circuit features described, enable single-supply, wide-range, fully temperature-compensated operation. A compensation technique significantly reduces errors caused by the finite ohmic emitter resistance of a BJT. To support use in logarithmically compressing the current generated by a photodiode, an adaptive bias signal can provided which maintains an essentially constant bias on the photodiode's internal junction.

24 Claims, 10 Drawing Sheets

GROUNDED EMITTER LOGARITHMIC CIRCUIT

This application claims priority from U.S. Provisional Patent Application 60/430,465 entitled "Grounded Emitter Logarithmic Circuit" by Barrie Gilbert, filed Dec. 2, 2002, Express Mail No. EV 007619677 US which is incorporated by reference.

BACKGROUND

A bipolar junction transistor (BJT) exhibits a very reliable mathematical relationship between its collector current ($I_C$) and its base-emitter voltage ($V_{BE}$). FIGS. 1A and 1B show that this relationship can be viewed in reciprocal ways. In FIG. 1A, an input signal is applied to an NPN transistor in the form of a voltage $V_{BE}$ across its base-emitter junction. In this connection mode the output is the collector current $I_C$, in essentially the following manner:

$$I_C = I_S \exp(V_{BE}/V_T) \quad \text{Eq. 1}$$

$V_T$ is the thermal voltage kT/q which is about 26 mV at 300° K, and $I_S$ is commonly called the "saturation current", which is a basic scaling parameter for a BJT and is invariably very much smaller than $I_C$ in practical situations. It will be apparent that the transistor may be a PNP type, with appropriate attention to signal polarities, fabricated in any bipolar technology.

In FIG. 1B, the transistor is operated in a reciprocal fashion. Here, the input signal is arranged to be the collector current $I_C$, while the output signal is now the base-emitter voltage which conforms essentially to the following equation (a rearrangement of Eq. 1):

$$V_{BE} = V_T \log(I_C/I_S) \quad \text{Eq. 2}$$

where $V_T$ and $I_S$ have the same meanings as in Eq. 1. Thus, the transistor can be configured and driven to provide either an exponential or a logarithmic response.

In FIG. 1B, a unity-gain current amplification element ensures that $I_C$ is unaffected by the base current of the transistor This element is usually realized by a simple BJT emitter-follower or a MOS (metal oxide semiconductor) source-follower of appropriate polarity.

One of the earliest practical circuits to utilize this logarithmic property of a BJT to realize a logarithmic amplifier (log amp) is shown in FIG. 2. In this arrangement, which is sometimes referred to as a "transdiode connection" or "Paterson diode," the base of Q1 is grounded, and the high-gain operational amplifier (op amp) OA1 is configured to force the collector current $I_C$ to equal the signal input current $I_X$ while maintaining the collector voltage near ground. The output signal voltage, generally named $V_{LOG}$, is then $$V_{LOG} = -V_T \log(I_X/I_S) \quad \text{Eq. 3}$$

It is common to use base-10 logarithms in such applications, in order to characterize the output directly in terms of decibel (dB) changes in the input signal. It is also common to characterize the operation of a log amp in terms of a "slope voltage," defined as the amount of change in the output for each decade change in the input magnitude, and an "intercept," which is the value of input at which the extrapolation of the output in Eq. 3 passes through zero. For a current-input, voltage-output log amp, the function is generally stated as $$V_{LOG} = V_Y \log_{10}(I_X/I_Z) \quad \text{Eq. 4}$$

where $V_{LOG}$ is the output voltage, $I_X$ is the input current, $V_Y$ is the slope voltage, and $I_Z$ is the intercept. From Eq. 3 it is apparent that the log amp of FIG. 2 has a slope voltage $V_Y$ of $-V_T$ and an intercept $I_Z$ of $I_S$. For the basic circuit, $V_Y$ is −26 mV log(10)≈−60 mV at T=300K.

At any given calibration temperature, the circuit of FIG. 2 can provide a remarkably accurate measure of the logarithm of a fixed-polarity, constant or moderately-rapid varying input current, and the op amp OA1 allows the output to be loaded while preserving accuracy. However, the saturation current $I_S$ is an extremely strong function of temperature, while the thermal voltage $V_T$ is proportional to absolute temperature (PTAT). Accordingly, further refinements are needed to ensure the calibration is essentially independent of temperature.

FIG. 3 illustrates a prior art elaboration of the Paterson diode connection providing a stable log-intercept through elimination of the temperature dependence of $I_S$. This scheme uses a second transistor Q2, nominally identical to Q1, and a second op amp OA2 configured as a unity-gain buffer (voltage follower) with its output fed back to its inverting (−) input terminal. With this topology the output is the difference of the two base-emitter voltages:

$$V_{LOG} = -V_T \log(I_Z/I_S) + V_T \log(I_X/I_S) \quad \text{Eq. 5a}$$

$$= V_T \log(I_X/I_Z) \quad \text{Eq. 5b}$$

$$= V_Y \log_{10}(I_X/I_Z) \quad \text{Eq. 5c}$$

where the inputs have been swapped to make $V_{LOG}$ turn out positive. Therefore, the uncertain value of $I_S$ has been eliminated, and the intercept is now determined by the reference current $I_Z$ which, using well-known techniques, can be supplied by an accurate and temperature-stable current source. This scheme offers "log-ratio" operation.

$V_{LOG}$ still has a temperature-dependent slope $V_T$=kT/q, alternatively written $V_Y$=(kT/q)log(10). A common circuit solution is shown in FIG. 4. It uses a resistor $R_1$ from the base of Q2 to ground, having a specific positive temperature-coefficient, slightly greater than PTAT; the feedback path around OA2 is completed using a temperature-stable resistor $R_2$.

Although the circuit of FIG. 4 is practical, the need for a special positive temperature-coefficient (TC) resistor is problematic, even in discrete realizations, and especially so for implementation as a monolithic integrated circuit. Breaking from this traditional solution, the prior art circuit of FIG. 5 uses translinear techniques to provide temperature compensation of the slope without the need for a positive-TC resistor. A translinear multiplier cell is used to form the feedback loop, and all resistors can now be temperature-stable. The compensation is achieved by using a PTAT current $I_T$, and a temperature-stable current $I_R$ for biasing the two halves of the multiplier cell. This circuit and further refinements thereof are described more fully in U.S. Pat. No. 4,604,532, by the same inventor as the present invention.

DETAILED DESCRIPTION

Figure 1A:
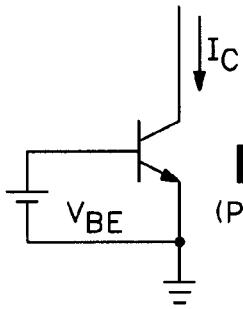
FIG.1A (PRIOR ART)
FIGS. 1A and 1B illustrate prior art circuits for demonstrating reciprocal views of the logarithmic/exponential relationship between the collector current and base-emitter voltage of a bipolar junction transistor.
Figure 1B:
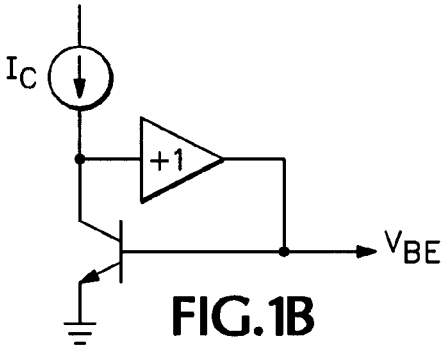
FIG.1B (PRIOR ART)
Figure 6:
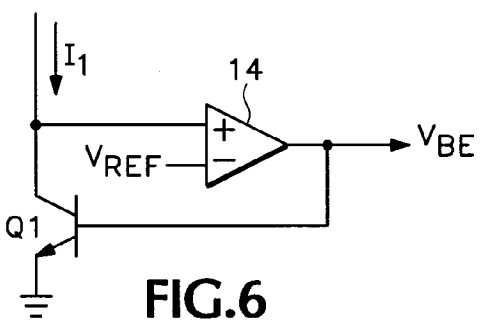
FIG. 6 illustrates an embodiment of a logarithmic responding circuit according to the present invention.
Figure 4:
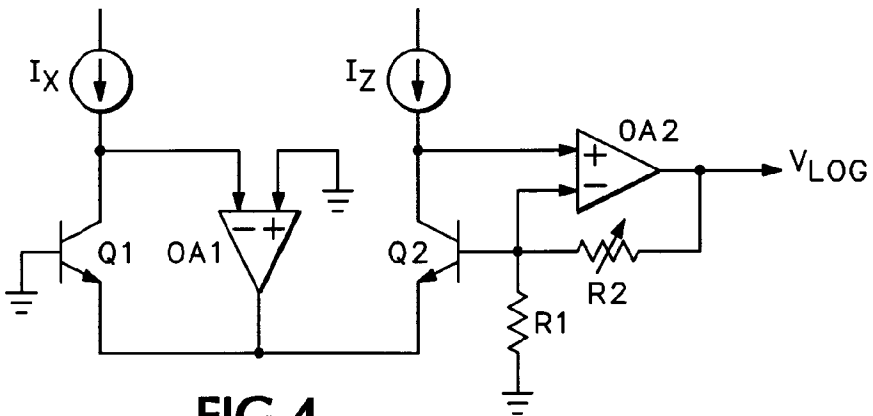
FIG.4 (PRIOR ART)
FIG. 4 illustrates a prior art log amp circuit with temperature compensation of both intercept and slope.
Figure 7:
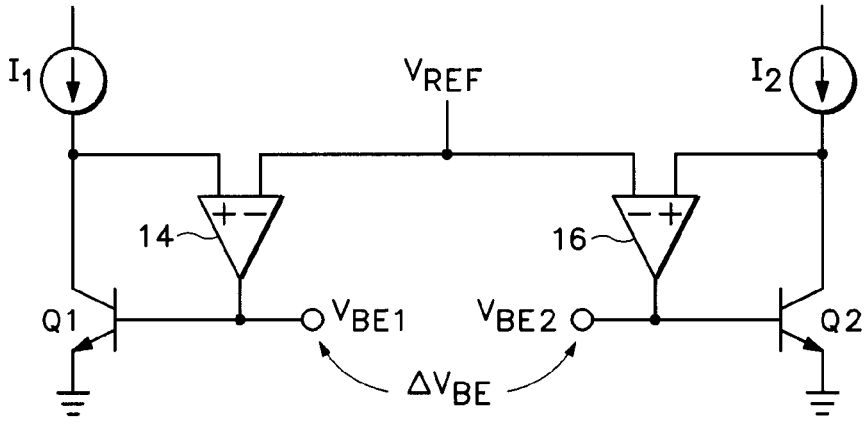
FIG. 7 illustrates an embodiment of a differential-output log-ratio responding circuit according to the present invention.

FIG. 6 illustrates an embodiment of a logarithmic-responding circuit (also referred to as a logarithmic circuit, a log circuit, or a log-ratio circuit) according to the present invention. The circuit of FIG. 6 includes a log transistor Q1 which has its emitter grounded and its collector arranged to receive an input current $I_1$. The base of Q1, from which the logarithmic output signal $V_{BE}$ is taken, is driven by a differential-input amplifier 14, preferably a high-gain, FET-input operational amplifier (op amp), which has its noninverting (+) input coupled to the collector of Q1 and its inverting (−) input coupled to a voltage $V_{REF}$ that sets the voltage at the input ("summing") node. This is in contrast to the low-gain, single-sided amplifier 10 shown in FIG. 1B. The collector-emitter voltage, $V_{CE}$, of transistor Q1 in FIG. 6 is now at a constant value, independent of $I_C$, determined by $V_{REF}$, which is usually, although not necessarily, temperature-stable. This scheme opens up possibilities for further novel and useful circuits in accordance with the present invention. For example, the circuit of FIG. 6 can be combined with a reference cell to form a differential-output log-ratio circuit, as shown in FIG. 7. The reference cell is implemented with a second log transistor Q2 having its emitter grounded and its collector arranged to receive a second input current $I_2$. A second amplifier 16 has its noninverting (+) input coupled to the collector of Q2 and its inverting (−) input coupled to the same reference voltage $V_{REF}$ as the first amplifier 14. In this embodiment, amplifiers 14 and 16 are preferably high-gain op amps, and $V_{REF}$ is typically 0.5 volts. The logarithmic output signal $\Delta V_{BE}$ is taken as the difference between the base voltages of Q1 and Q2 and behaves according to the following equation:

$$\Delta V_{BE}=V_{BE1}-V_{BE2}=V_T \log(I_1/I_2) \qquad \text{Eq. 6}$$

If the second input current $I_2$ is stable with temperature, and transistors Q1 and Q2 are isothermal and nominally identical, the circuit of FIG. 7 provides a log amp in which the intercept has been temperature stabilized. That is, the highly temperature and process dependent saturation current $I_S$ for Q1 cancels the $I_S$ of Q2, so the intercept depends only on the value of $I_2$. The relative emitter sizes of Q1 and Q2 can also be different, to provide additional flexibility in the logarithmic scaling. The temperature variability in the slope remains, introduced by the thermal voltage $V_T$=kT/q in Eq. 6. This remaining temperature-dependence can be eliminated by using a circuit as shown in generic form in FIG. 8, where the action of the temperature compensation circuit 18 is to essentially divide the differential base voltage $\Delta V_{BE}$ by a PTAT voltage, and also scale the resulting slope voltage to generate an accurate, temperature-stable output $V_{LOG}$, as will be described in more detail below. This block uses a translinear multiplier cell to implement the temperature compensation of the thermal voltage $V_T$ in Eq. 6, thereby stabilizing the slope and providing the following output:

$$V_{LOG}=V_Y \log(I_1/I_2) \qquad \text{Eq. 7}$$

where $V_Y$ is a temperature independent slope voltage, whose value is a design parameter.

Figure 8:
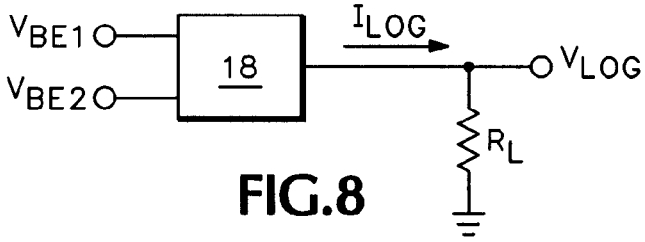
FIG. 8 is a simplified block diagram of a temperature compensation circuit for a logarithmic circuit according to the present invention.

It will be apparent that the second input terminal in the embodiments of FIGS. 7 and 8 receiving the current $I_2$ can also be used to realize log-ratio operation rather than a log amp having a fixed intercept. Also, the temperature-stabilization block in FIG. 8 can be arranged to provide an output current rather voltage, in which case, the slope is expressed as a slope current, which is the change in output current for a ratio change of one decade at the input.

Voltage Input

Figure 9:
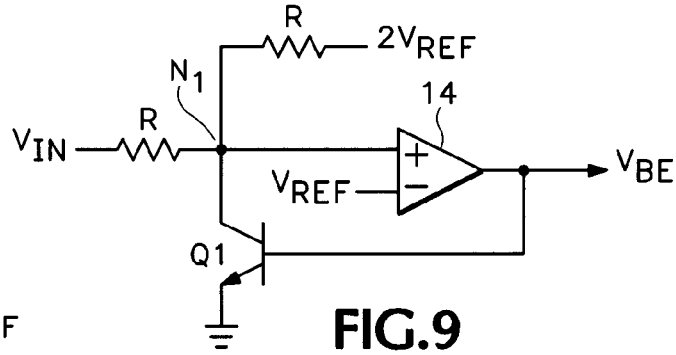
FIG. 9 illustrates an embodiment of a voltage-input logarithmic circuit according to the present invention.

FIG. 9 illustrates another embodiment of a logarithmic circuit according to the present invention. In this embodiment, the base of a grounded-emitter transistor Q1 is again driven by an amplifier 14 which has its inverting input tied to a fixed voltage $V_{REF}$. However, the input signal is now applied as a ground-referenced voltage $V_{IN}$ to one end of a resistor R which has its other end connected to the current summing node $N_1$ at the collector of Q1. The current through this resistor R is therefore $V_{IN}-V_{REF})/R$. If this were the only current applied to the collector of Q1, the output would be in error. Using a second resistor having the same value R connected between the summing node $N_1$ and a second bias voltage having twice the value of $V_{REF}$. This provides an additional current $V_{REF}/R$ to the summing node. Therefore, the collector current of Q1 is restored to the required value, $V_{IN}/R$. The output is then taken from the base of Q1 as follows:

$$V_{BE}=V_T \log((V_{IN}/R)/I_S) \quad \text{Eq. 8}$$

The slope and intercept temperature-compensation techniques according to the present invention described above with reference to FIGS. 7 and 8 will usually also apply to the embodiment of FIG. 9, as well as other embodiments of the present invention.

Emitter Resistance Compensation

Figure 10:
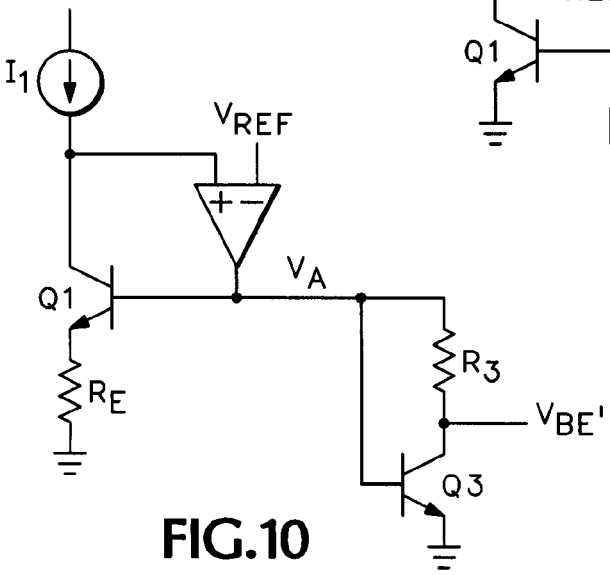
FIG. 10 illustrates an embodiment of an emitter resistance compensation scheme according to the present invention.

FIG. 10 illustrates yet another aspect of the present invention which relates to a method for minimizing the error in $V_{BE}$ caused by the finite ohmic resistance always present in the emitter branch of a transistor. The relationship between the intrinsic base-emitter voltage and collector current conforms closely to logarithmic over a very wide range of currents. However, at relatively high currents levels (depending on the device type and size) the ohmic resistance in the emitter, arising from the particulars of the construction process, generates an additive component to the $V_{BE}$. While this resistance is an inseparable part of the transistor, it is shown in FIG. 10 as an external resistor $R_E$ interposed between the emitter of Q1 and ground, for purposes of illustration. Due to $R_E$, the voltage VA at the base of Q1 is now $V_{BE1}+I_ER_E \approx V_{BE1}+I_1R_E$. At relatively high current levels, this ohmic component of $V_{BE}$ can introduce a serious error in the corresponding logarithmic value of the output.

To address this problem, the circuit of FIG. 10 generates a compensating voltage of the same magnitude, $I_1R_E$. The corrected base-emitter voltage $V_{BE}'$ more accurately represents what the base-emitter voltage of Q1 would be in the absence of its ohmic emitter resistance. In the embodiment of FIG. 10, this voltage appears at the collector of another suitably scaled and isothermal transistor Q3 which has its emitter grounded and its base connected to the base of Q1. A resistor $R_3$ is connected between the collector and base of Q3. The value of $R_3$ is chosen so that when the voltage $V_A=V_{BE1}+I_1R_E$ is applied to the base of Q3, the current $I_3$ through the collector of Q3 creates a voltage across $R_3$ that precisely cancels the voltage across $R_E$. Thus, the voltage $V_{BE}'$ at the collector of Q3 is an accurate translation of the intrinsic base-emitter voltage of Q1 corresponding to the input current $I_1$. Transistor Q3 is preferably arranged to operate at a lower current level than Q1, in part, to minimize the total current consumed by the integrated circuit (IC).

Figure 11:
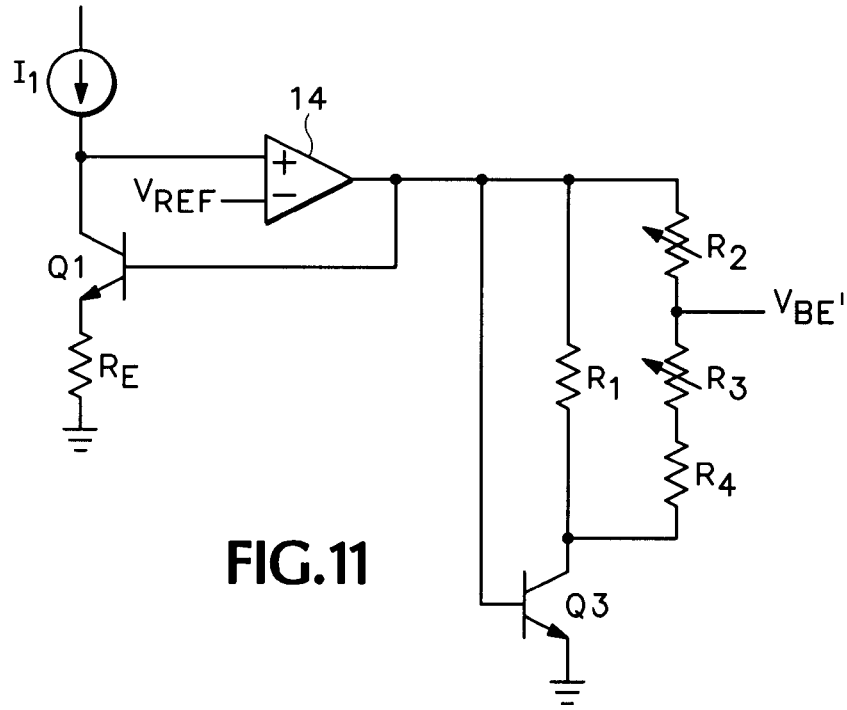
FIG. 11 illustrates a technique for providing adjustability and facilitating manufacturing of an emitter resistance compensation circuit according to the present invention.

FIG. 11 illustrates another embodiment of an $R_E$ compensation scheme according to the present invention. It addresses problems associated with the accurate realization of the technique in monolithic form. For a typical transistor, of the type used in log amps, $R_E$ may be several ohms. If Q3 was identical to Q1, $R_3$ in FIG. 10 would need to have a similarly low value. However, it is often difficult to create accurate resistors having values of only a few ohms on an IC, without using excessive die area. This aspect of the problem is solved by using a much smaller transistor for Q3, which thus operates at a much lower current level than Q1, and thus raises the required value of $R_E$ proportionately. For example, if Q3 is one-fiftieth the size Q1, and $R_E$=5Ω, then $R_1$ would have a value of about 250Ω. To reduce the high-current error further, resistor $R_1$ is implemented as a parallel-series network as shown in FIG. 11. $R_E$ will vary due to production tolerances. By making $R_2$ and $R_3$ trimmable, bi-directional nulling of the high-current error is possible during manufacture. $R_4$ is added to dilute and center this adjustment range, which is typically only a few percent. These various $R_E$ compensation techniques can be used alone or in combination with other aspects of the present invention described herein.

Adaptive Detector Bias

Figure 12:
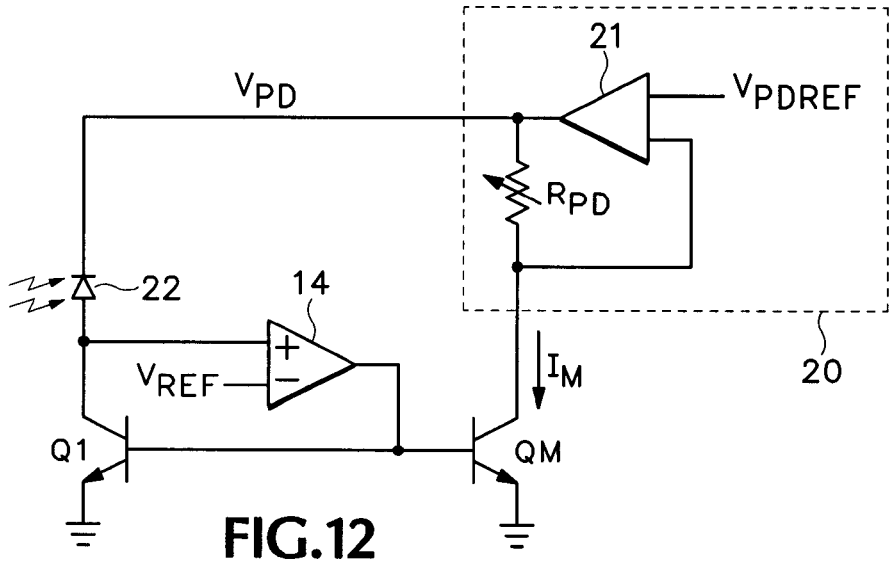
FIG. 12 illustrates an embodiment of an adaptive bias scheme for a sensor for a logarithmic circuit according to the present invention.

FIG. 12 illustrates a further aspect of the present invention which relates to a technique for adaptively biasing a sensor, typically a photodiode, used to provide the input signal to a logarithmic circuit according to the present invention. For example, in fiber-optic systems, a small portion (typically about 2 percent) of the total optical signal is tapped from the fiber-optic path and diverted to a photodiode detector which generates a current that is proportional to the total optical power. Log amps are increasingly being used to measure the signal current from photodiodes because the logarithmic characteristic allows a very wide range of signal currents to be represented in a conveniently compressed format. At low illumination levels, where the signal current may be only nanoamps, various sources of leakage current can impair accuracy. The reverse bias across the junction of such a photodiode should thus be minimized for this condition. A reverse bias of about 0.1V may suffice at low illumination. But as the illumination, and therefore the diode current, increases, the internal resistance of the diode causes the junction to lose bias voltage. For this condition, a high applied bias is thus more appropriate. It is previously known in the art that the applied bias voltage should preferably be increased as the diode signal current increases, so as to maintain an essentially constant, or at least a guaranteed minimum, internal junction bias.

A logarithmic responding circuit according to the present invention can be easily extended to provide adaptive biasing of a detector such as a photodiode. FIG. 12 illustrates an adjunct circuit capable of providing adaptive biasing according to the present invention. The log transistor Q1 and differential-input amplifier 14 are arranged as in the embodiment of FIG. 6. The circuit of FIG. 12 adds a small transistor QM whose collector current, $I_M$, is a scaled-down replica of the current in Q1. $I_M$ may then be processed in any suitable manner to provide the adaptive biasing necessary for the particular type of detector being used.

Since photodiode biasing is one of the more valuable applications for the circuit of FIG. 12, further implementation details relevant to this application have been included by way of example. The replica current $I_M$ is received by a transresistance stage 20 which converts this current to a voltage $V_{PD}$ that can directly drive the cathode of a photodiode 22. The anode of the photodiode is connected to the collector of Q1 so as to provide the photodiode current $I_{PD}$ as the input current $I_1$ to the log amp. The transresistance stage 20 includes a resistor $R_{PD}$ connected between the collector of QM and the photodiode bias terminal $V_{PD}$ which is driven by the output of op amp 21. The (−) input of the op amp connects to the node between $R_{PD}$ and the collector of QM, while a fixed voltage $V_{PDMIN}$, which determines the minimum value of $V_{PD}$, is applied to its (+) input.

In a preferred embodiment, transistor QM is sized to provide a 25:1 ratio between $I_1$ and $I_M$, and the resistance of $R_{PD}$ is made equal to 25 times the nominal series resistance of the photodiode, assumed to be 200Ω, that is, $R_{PD}$=5Ω. To ensure accurate scaling of $V_{PD}$, this resistor would be trimmed to absolute value. With the photodiode anode at a summing node potential of 0.5V, and $V_{PDMIN}$ set to 0.6V, the minimum bias $V_{PD}$ on the photodiode cathode will likewise be 0.6V for $I_{PD}$=0, thus reverse-biasing the diode by 0.1V. For $I_{PD}$=10 mA this voltage will rise to 2.6 V, providing a photodiode bias of 1V. This will result in a constant internal junction bias of 0.1V for a photodiode having a series resistance of 200Ω. However, tolerancing considerations require a somewhat larger slope of $V_{PD}$ vs. $I_{PD}$, that is, a higher value of $R_{PD}$. It will be apparent that other values of the transistor ratio and $R_{PD}$ may be used.

Single-Supply and Dual-Supply Operation

A disadvantage of the prior art log amps illustrated in FIGS. 2–5 is that they generally require both positive and negative power supplies. For example, referring to the circuit of FIG. 3, the op amp OA1 must drive the transistor emitters with a negative voltage since their bases are at (Q1) or close to (Q2) ground potential, while OA2 delivers an output $V_W$ that may swing from negative to positive values.

An advantage of a logarithmic circuit according to the present invention is that it allows single-supply operation, since in the base-driven arrangement of the log transistor, its emitter is grounded, and all other potentials can be arranged to always be positive.

The term "grounded" as used herein does not necessarily mean connected to a point of zero potential, because the reference point of zero potential can be designated arbitrarily in any system. For example, the positive supply voltage might arbitrarily be designated as the point of zero potential, in which case, the node identified as ground in these circuits could be a negative power supply, but would function as "ground" for purposes of the present invention. Alternatively, if a PNP transistor is used for the log transistor, the polarity of the entire circuit would be inverted. In this case, the positive supply voltage could be the ground point for the circuit, or be the true zero potential ground if a negative supply is used.

Figure 2:
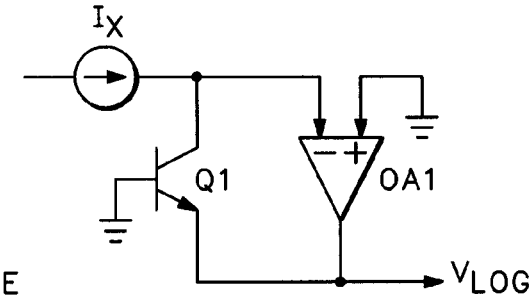
FIG.2 (PRIOR ART)
FIG. 2 illustrates a widely-used prior art log amp circuit.
Figure 3:
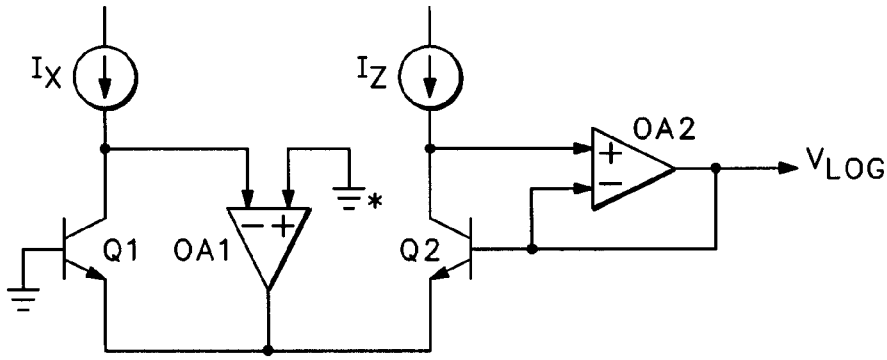
FIG.3 (PRIOR ART)
FIG. 3 illustrates a prior art log amp circuit with temperature compensated intercept.
Figure 5:
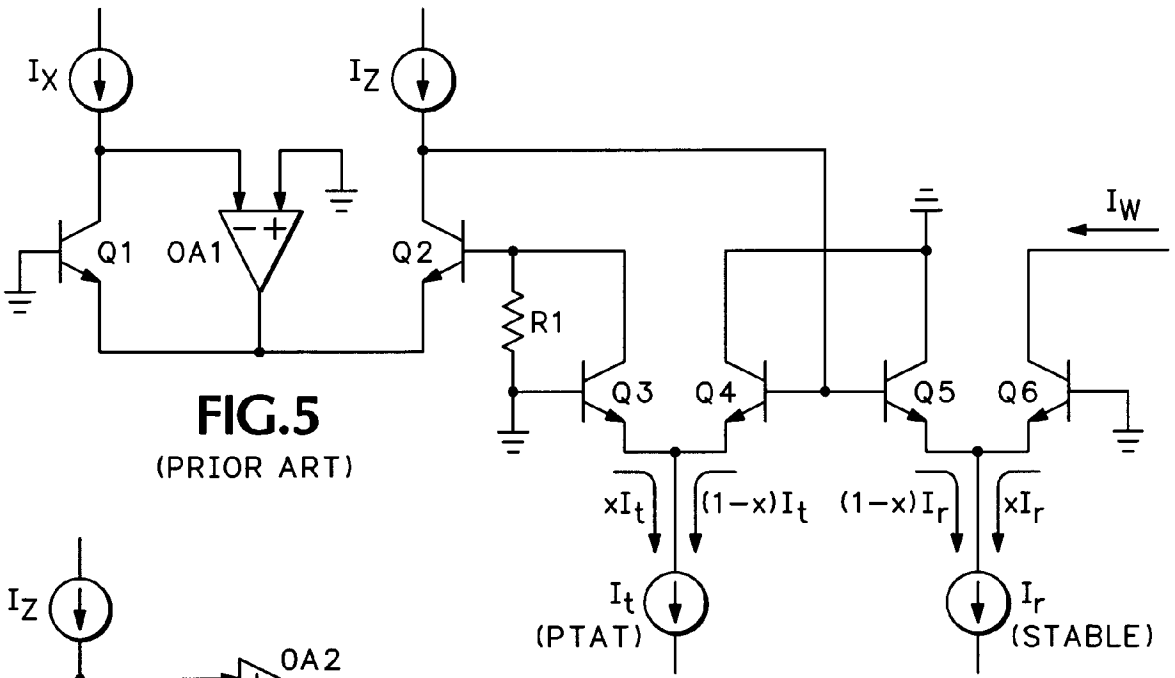
FIG.5 (PRIOR ART)
FIG. 5 illustrates a prior art log amp circuit that utilizes translinear techniques to achieve temperature compensation.

The emitter of a log transistor according to the present invention can be considered grounded as long as it is anchored to a suitable point of reference, since the output from the differential-input amplifier drives the base of the log transistor rather than its emitter as in the prior art circuit of FIG. 2. Moreover, the potential at this anchor node does not necessarily have to be accurate, especially in the case of dual-supply operation, as discussed next.

Although a logarithmic circuit according to the present invention is particularly well suited for single-supply operation, it can also operate from dual supplies, to provide further flexibility of use. In conventional log amps, the collector of the log transistor (the "current summing" node) is generally held at ground potential. When a logarithmic circuit according to the present invention is operated from a single power supply, as for example in FIG. 12, the collector of Q1 operates at $V_{CE}$=$V_{REF}$, a small positive voltage, preferably 0.5V, although it could be smaller. In a photodiode application, operation with its anode somewhat above ground potential will generally not pose a problem. However, for compatibility with systems that demand the summing node to be at ground potential, a logarithmic circuit according to the present invention can be configured for dual-supply operation as shown in FIG. 13.

Figure 13:
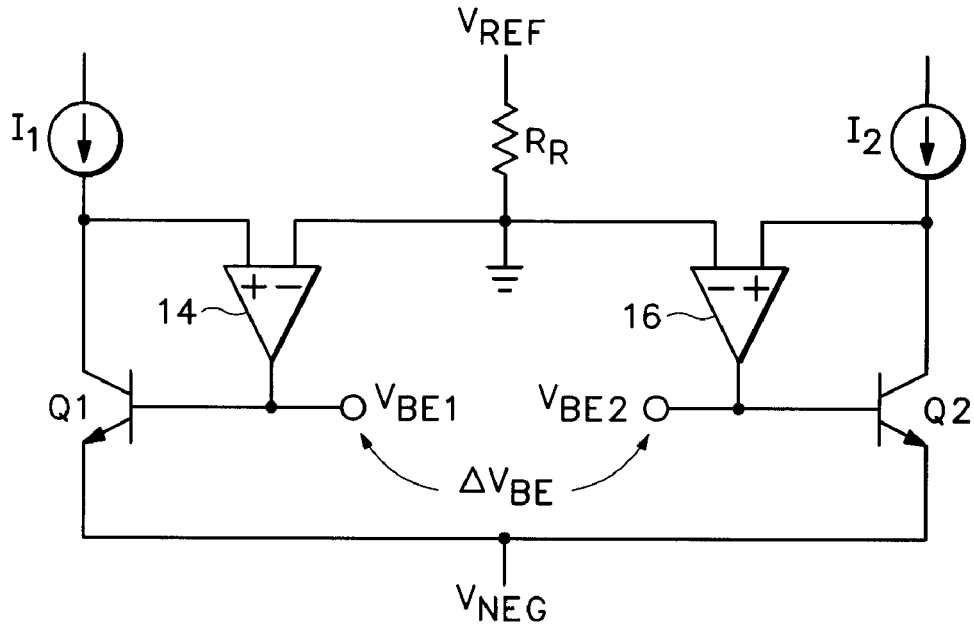
FIG. 13 illustrates an embodiment of a logarithmic circuit arranged for dual-supply operation according to the present invention.

In the embodiment of FIG. 13, the inverting (−) input of the differential-input amplifier 14 is grounded to a node at zero potential, and the emitter of log transistor Q1 is now connected to a negative power-supply voltage $V_{NEG}$. The summing-node voltage $V_{REF}$ is connected to the (−) inputs of the differential-input amplifiers 14 and 16 through a resistor $R_R$ within the integrated circuit, allowing the (−) input of these amplifiers to be connected to ground. Since their input offset voltage is generally small, the input terminals 13 and 15 are likewise at essentially ground potential. The positive supply $V_{POS}$ supports these amplifiers and any other support circuitry. With a $V_{NEG}$ of only −0.5V, the $V_{CE}$ of Q1 and Q2 is 0.5V, as would be the case when configured for single-supply operation using a $V_{REF}$ of 0.5V. In the dual-supply mode, higher values of $V_{NEG}$ may be used with essentially no effect on accuracy.

Temperature Compensation

Figure 14:
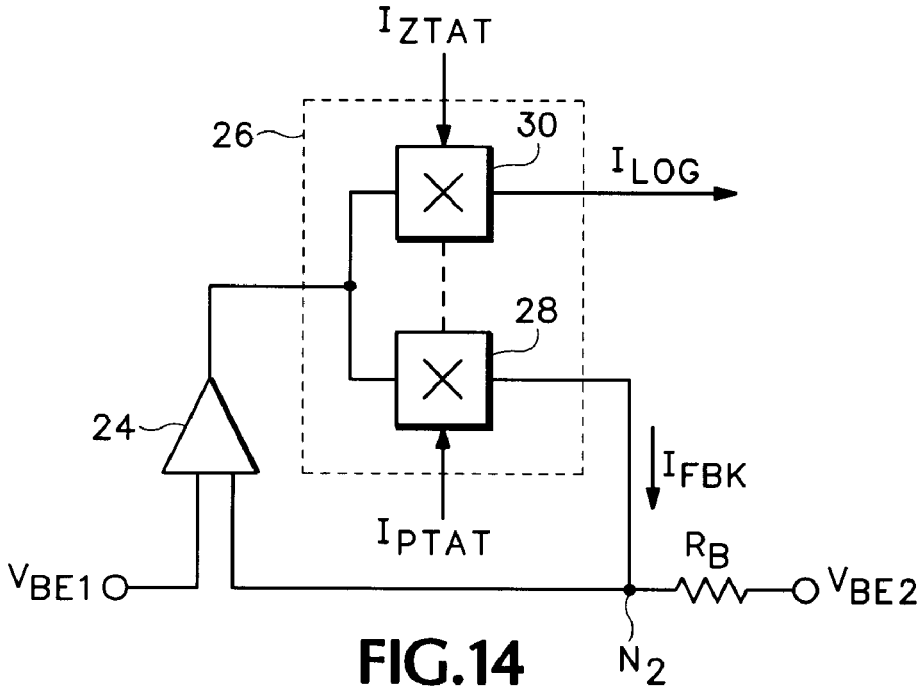
FIG. 14 illustrates an embodiment of temperature compensation scheme for a logarithmic circuit according to the present invention.

FIG. 14 illustrates an embodiment of a temperature compensation scheme for a logarithmic circuit according to the present invention. The input to the circuit of FIG. 14 is the $\Delta V_{BE}$ from a pair of log transistors, such as shown in FIGS. 7 and 13. Thus, the input terminals of this circuit are identified as $V_{BE1}$ and $V_{BE2}$. (Using the $R_E$ compensation scheme for the first log transistor, described above with reference to FIG. 10, the $R_E$-compensated base-emitter voltage $V_{BE1}'$ is substituted for $V_{BE1}$.) A base resistor $R_B$ is connected between $V_{BE2}$ and a node $N_2$. One input of a high-gain differential-input amplifier 24 is connected to $V_{BE1}$ and its other input connected to $N_2$. A dual multiplier 26 comprises two multiplier half-cells 28 and 30; each has one numerator input that is driven by the intermediate signal at the output of amplifier 24. Multiplier half-cell 28 receives its second numerator input $I_{PTAT}$, which is proportional to absolute temperature, while the second numerator input to multiplier half-cell 30, $I_{ZTAT}$, is stable with temperature. The current-mode output of multiplier core 28 drives node $N_2$ with a current $I_{FBK}$. The output current, $I_{LOG}$, is provided by the multiplier half-cell 30. Other signal forms (e.g. voltages) might be used in other implementations.

The high-gain differential-input amplifier 24 acts as a null detector. It servos the feedback loop via $I_{FBK}$ so as to minimize the voltage across its input terminals, ideally to zero. This results in $\Delta V_{BE}$ appearing across $R_B$, necessitating a feedback current $I_{FBK}=\Delta V_{BE}/R_B$. Since $I_{FBK}$ is PTAT (proportional to absolute temperature), and $I_{PTAT}$ and $I_{ZTAT}$ are each multiplied by a common numerator, that is, the output from amplifier 24, the output $I_{LOG}$ is fully temperature compensated, in a fundamentally correct fashion. This also allows resistor $R_B$ to be temperature stable, rather than a specially-designed component.

When this temperature compensation scheme is used with the logarithmic circuits described above with reference to FIGS. 7 and 8, and a fixed value of $I_2$ is used to define the log intercept, the apparatus for biasing the second log transistor may optionally be simplified. That is, the collector of Q2 does not need to be referenced to $V_{REF}$ or driven by a high-gain amplifier, unless true log-ratio operation is required.

Figure 15:
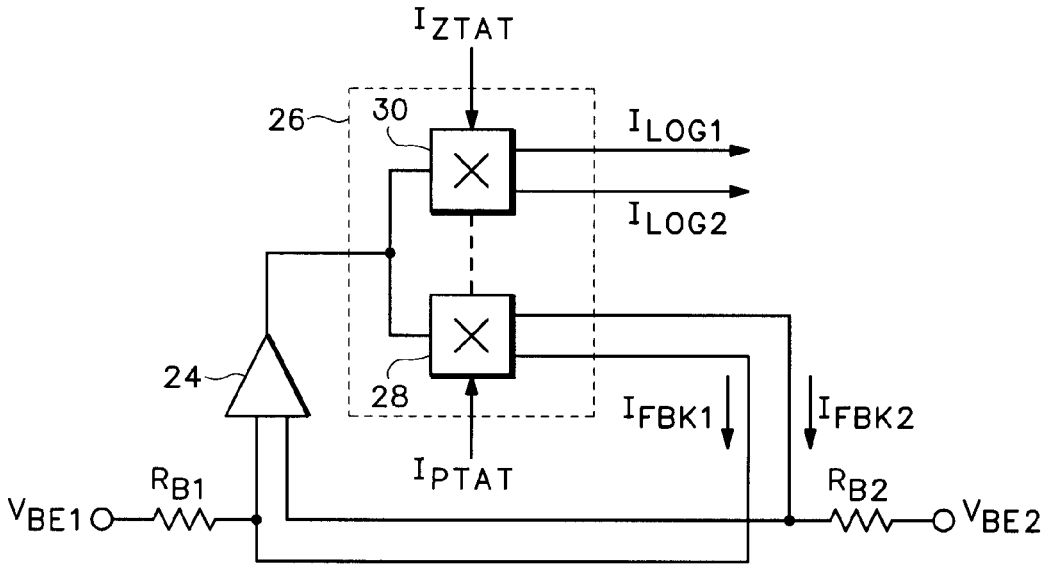
FIG. 15 illustrates a differential embodiment of temperature compensation scheme for a logarithmic circuit according to the present invention.

FIG. 15 illustrates an embodiment of a precise temperature-compensation scheme for a logarithmic circuit employing a fully differential structure, according to the present invention. The general structure and operation of this circuit is similar to that of FIG. 14, but now, the scaling resistance $R_B$ has been split into $R_{B1}$ and $R_{B2}$, and the multiplier half-cells have fully differential outputs. Amplifier 24 servos the feedback loop so as to generate $I_{FBK1}$ and $I_{FBK2}$ such that the total $\Delta V_{BE}$ appears across the sum of $R_{B1}$, and $R_{B2}$.

Details of an exemplary embodiment of the temperature compensation illustrated in FIG. 14 will now be described, with reference to FIGS. 16 and 17.

Figure 16:
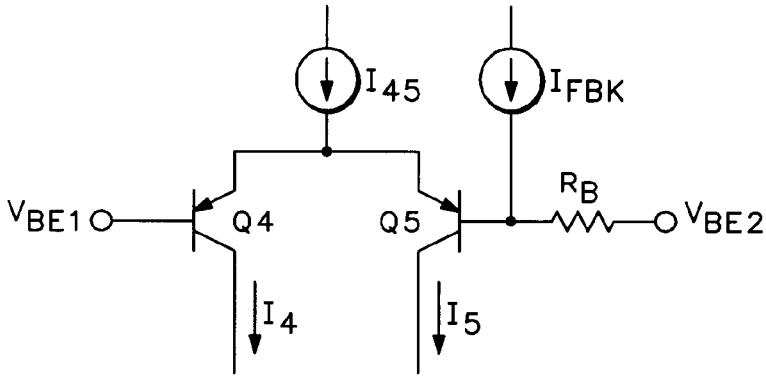
FIG. 16 illustrates an embodiment of an input section for a temperature compensation circuit according to the present invention.

Referring to FIG. 16, transistors Q4 and Q5 form a transconductance (gm) cell which functions as just the input stage to the complete high-gain differential-input amplifier that drives the multiplier half-cells so as to force the PTAT feedback current $I_{FBK}$ to equalize the base voltages of these transistors. Resistor $R_B$ is connected between the base of Q5 and $V_{BE2}$ and absorbs essentially the full current $I_{FBK}$. Tail current $I_{45}$ splits into $I_4$ and $I_5$ in response to the voltage difference between the bases of Q4 and Q5. The folded cascode described below, and which is the next part of the feedback loop, forces $I_4=I_5$. Thus, the base voltages of $Q_4$ and $Q_5$ are equalized, forcing $\Delta V_{BE}=V_{BE1}-V_{BE2}$ to be established across $R_B$.

Figure 17:
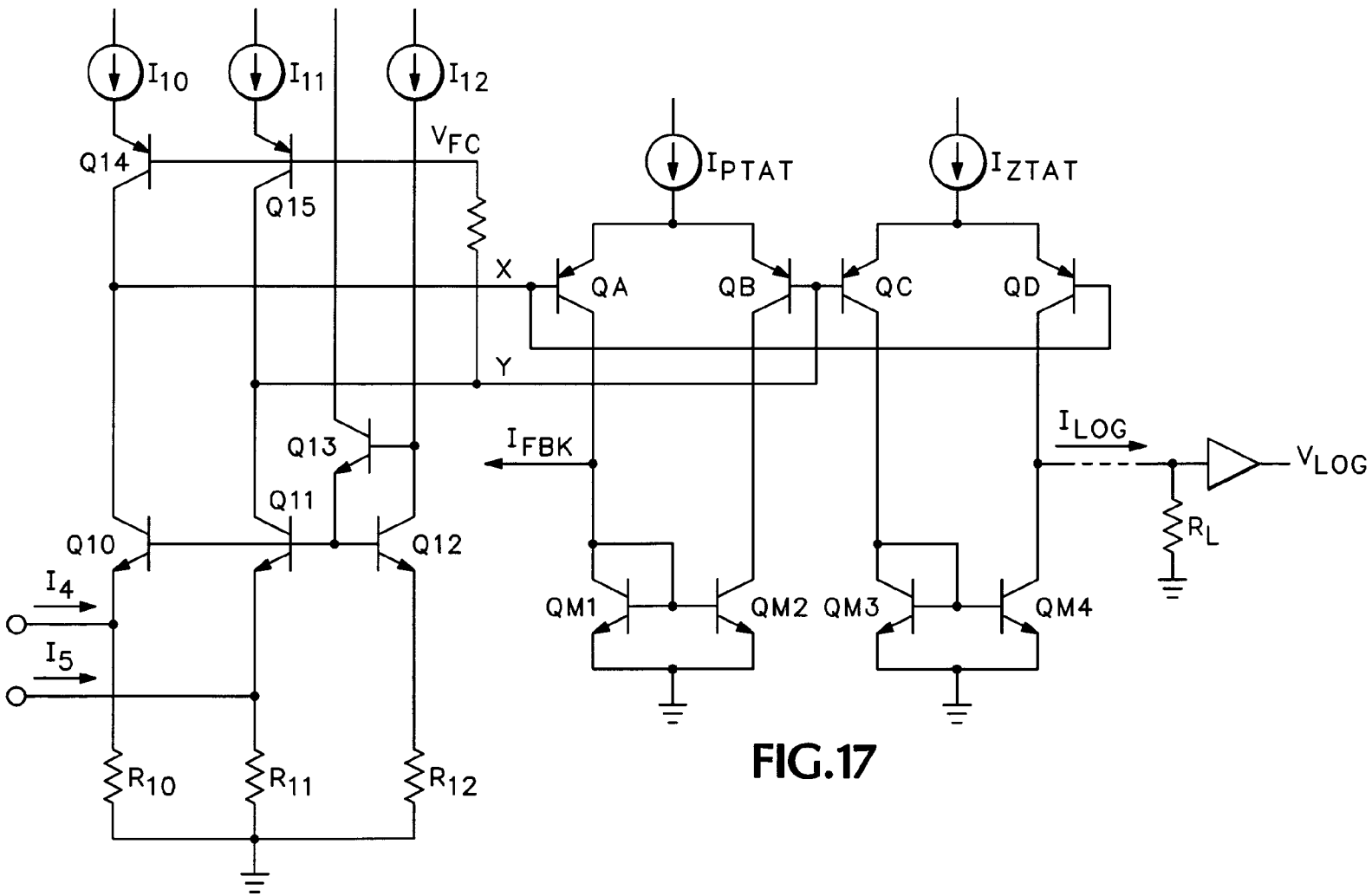
FIG. 17 is a simplified schematic of an embodiment of a folded cascode and multiplier arrangement for a temperature compensation circuit according to the present invention.

Referring to FIG. 17, transistors Q10–Q15, current sources $I_{10}$–$I_{12}$, and resistors $R_{10}$–$R_{14}$ complete the amplifier that eventually balances the currents $I_4$ and $I_5$. The differential voltage $V_{XY}$ between nodes X and Y drives the dual multiplier formed by transistor pairs QA,QB and QC,QD. In a practical embodiment, one or more emitter follower stages might be inserted at the branch points X and Y to provide level shifting or additional current gain. Transistors QA and QB form a first multiplier half-cell biased by a PTAT tail current $I_{PTAT}$; transistors QC and QD form a second multiplier half-cell biased by a temperature-stable tail current $I_{ZTAT}$. These four transistors form the core of a translinear multiplier, having as a common numerator input the voltage $V_{XY}$. It is well-known that this forces the ratio of the collector currents in QA and QB to equal the ratio of the collector currents in QC and QD, provided the emitter area factor $A_{QA}A_{QC}/A_{QB}A_{QD}=1$. FIG. 17 shows the collector currents of QA and QB as $xI_{PTAT}$ and $(1-x)I_{PTAT}$, respectively, where x is a modulation factor that varies between 0 and 1. The collector currents of QC and QD are then $(1-x)I_{ZTAT}$ and $xI_{ZTAT}$, respectively.

These two differential pairs of currents are converted to the single-sided form $I_{FBK}=(2x-1)I_{PTAT}$ and $I_{LOG}=(2x-1)I_{ZTAT}$ respectively, by two current mirrors, formed in this figure by transistors QM1,QM2 and QM3,QM4. $I_{FBK}$ is fed back to the $R_B$ of FIG. 16. FIG. 17 also shows how the output $I_{LOG}$ may be converted to a temperature-stable output voltage, of value $V_{LOG}=(I_{ZAT}/I_{PTAT})(R_L/R_B)\Delta V_{BE}$. Using the form of Eq. 6 this can be written $KV_{TR}\log(I_1/I_2)$, where $K=(I_{ZAT}/I_{PTAT})(R_L/R_B)$ and $V_{TR}=kT_R/q$, where $T_R$ is the design-center temperature. The required temperature-compensation is embedded in the slope factor K, which may also be used to adjust the log slope, in principle by varying either $I_{PTAT}$ or $I_{ZTAT}$.

Figure 18:
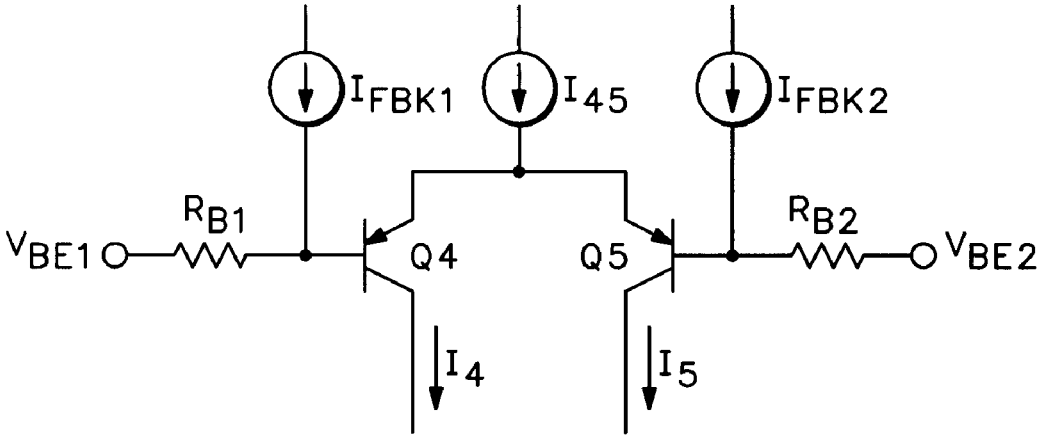
FIG. 18 illustrates an embodiment of a differential input section for a temperature compensation circuit according to the present invention.

FIG. 18 illustrates a fully differential variant of the arrangement of FIG. 16.

Intercept Reposition and Trim

Referring to FIG. 17 and equation above, it is apparent that the single-sided output $V_{LOG}$ may have either polarity depending on the ratio $I_1/I_2$. That is, $I_{LOG}$ flows out of the circuit over that portion of the log amp's input range where $I_1/I_2>1$, and toward the circuit when $I_1/I_2<1$. In many practical situations, and especially when using a single supply, the output should preferably be of fixed polarity. This may require a repositioning of the log intercept, which can be accomplished using various techniques according to the present invention.

Figure 19:
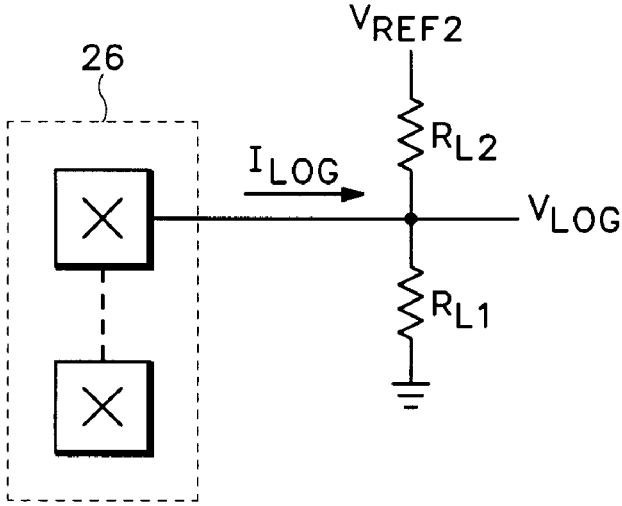
FIG. 19 illustrates a technique for adjusting the intercept of a logarithmic circuit according to the present invention.

One option is to simply supply an additive current to $I_{LOG}$ to ensure that $V_{LOG}$ is always positive over the entire range $I_1/I_2$. Equivalently, the load resistor $R_L$ of FIG. 17 can be returned to a positive bias rather than ground, as shown in FIG. 19. The parallel resistance of $R_{L1}$ and $R_L$ is made equal to $R_L$, and their ratio is chosen so that the fraction $R_{L1}/(R_{L1}+R_{L2})$ of $V_{REF}$ ensures that $V_{LOG}$ is always positive.

Figure 20:
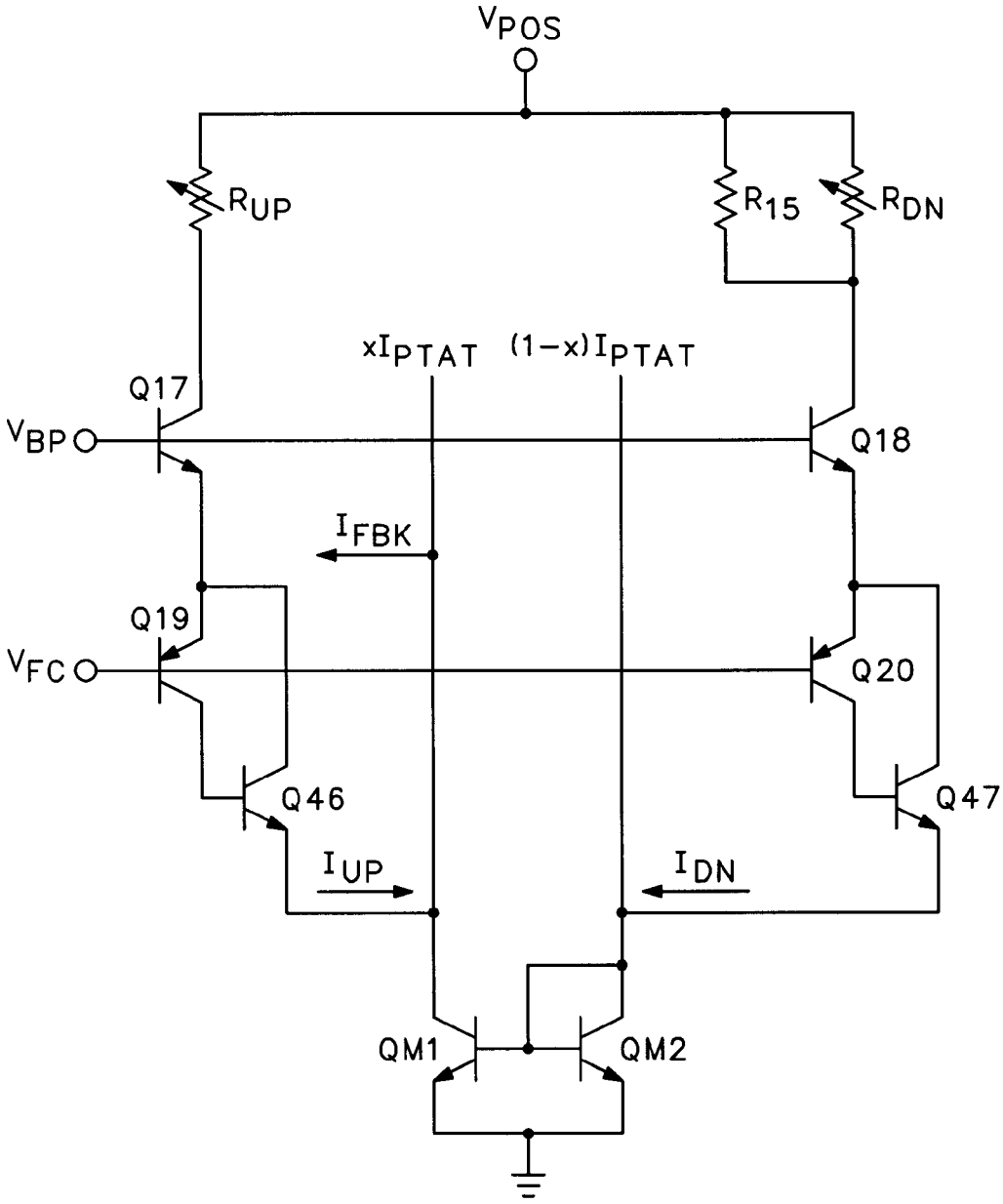
FIG. 20 illustrates an embodiment of a circuit for adjusting the intercept of a logarithmic circuit according to the present invention.

In a fully-calibrated implementation of a log amp, the precise value of the intercept may need to be trimmed to eliminate manufacturing tolerances, as well as repositioned. FIG. 20 shows a suitable circuit, in which the current mirror QM1 and QM2 from FIG. 17 is shown at the bottom of the figure. (The multiplier has been omitted to simplify the drawing). Transistors Q17 and Q18 are biased by $V_{BP}$ to generate PTAT currents $I_{DN}$ and $I_{UP}$ which are added to the feedback signals $xI_{PTAT}$ and $(1-x)I_{PTAT}$, respectively. Resistor R15, connected between the emitter of Q18 and the positive power supply $V_{POS}$, introduces most of the imbalance between $I_{UP}$ and $I_{DN}$ as required to reposition the intercept, that is, $I_{UP}>>I_{DN}$. Trimmable resistors $R_{UP}$ and $R_{DN}$ provide for fine adjustment of the relative current offset introduced into the current mirror, and thus, the amount of by which the intercept is shifted. This trim is bi-directional; that is, the intercept can be either increased or decreased, and is temperature-stable, because $I_{UP}$ and $I_{DN}$, which should be PTAT, remain so after trimming.

Transistors Q19 and Q46 form a current cascode with an effective "alpha" of almost exactly 1, ensuring that the accuracy of the current $I_{DN}$ is unimpaired by the finite current gain of a simple cascode, which, being temperature-sensitive, might degrade the intercept stability. Likewise, transistors Q20 and Q47 avoid alpha errors in $I_{UP}$. The bases of Q19 and Q20 are biased by $V_{FC}$ chosen to provide an optimal bias for the collectors of Q17 and Q18.

Slope Trim

Figure 21:
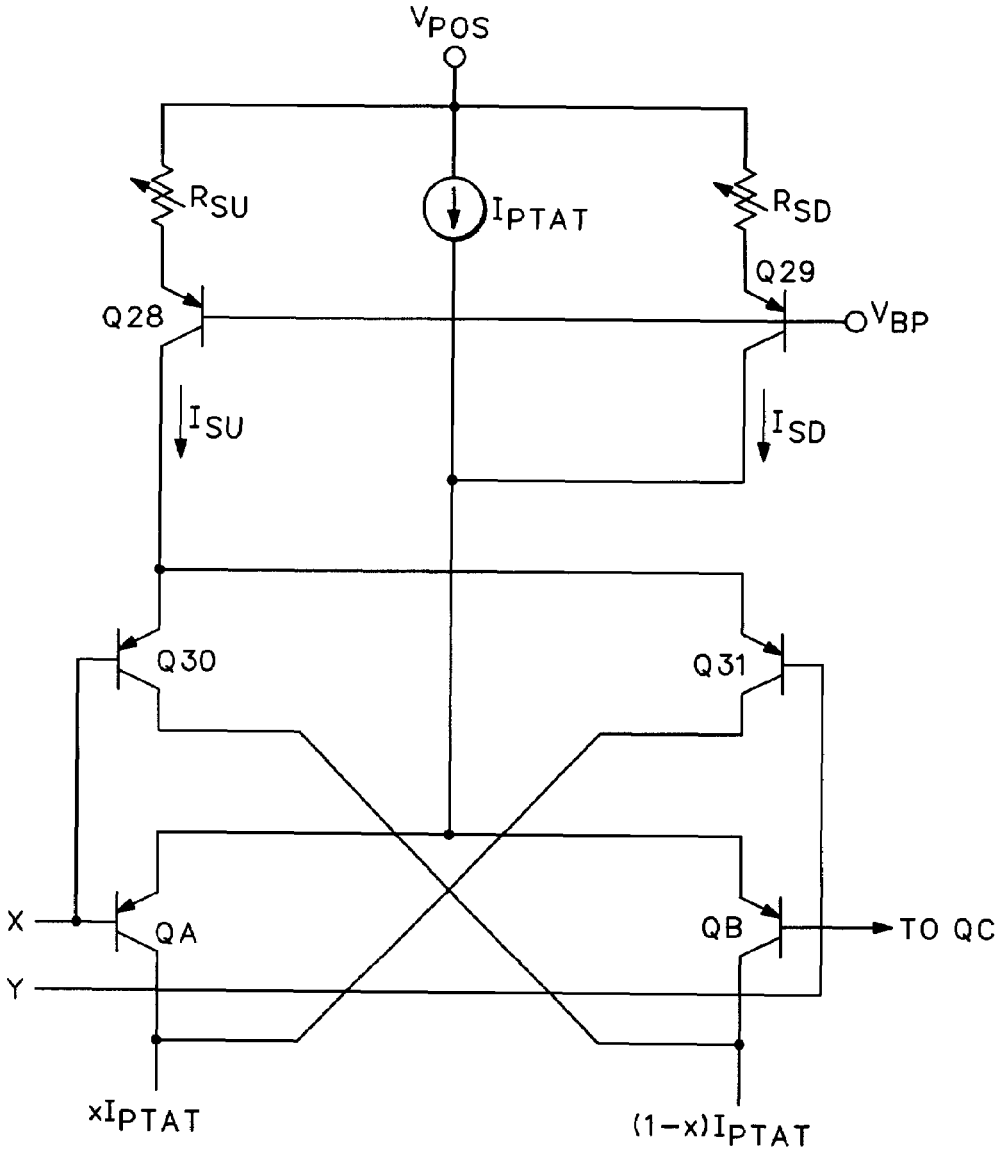
FIG. 21 illustrates an embodiment of a circuit for adjusting the slope of a logarithmic circuit according to the present invention.

A further refinement for a logarithmic circuit according to the present invention involves a technique for adjusting the slope without introducing a temperature sensitivity. Referring to FIG. 21, transistors QA and QB of the dual multiplier of FIG. 17 are augmented by cross-connected transistors Q30 and Q31 which receive a PTAT tail current $I_{SU}$ from current-source Q28. Likewise, current-source Q29 provides a current $I_{SD}$ which is added to the main tail current $I_{PTAT}$ at the common emitter node of QA and QB. Q28 and Q29 are biased by $V_{BP}$ in conjunction with the trimmable resistors $R_{SU}$ and $R_{SD}$, respectively.

With $R_{SU}$ and $R_{SD}$ unadjusted, or trimmed so that the currents $I_{SU}$ and $I_{SD}$ are equal, the effective gm of this composite half-cell of the multiplier remains at its nominal value, because of the canceling cross-connection of the collectors of QA, QB, Q30 and Q31. If $I_{SD}$ is decreased by trimming (that is, increasing) $R_{SD}$ the log slope is effectively lowered and vice versa, because an imbalance between $I_{SU}$ and $I_{SD}$ changes the net gm of this augmented half-cell. Thus, when $I_{SD}$ is decreased, the net gm is decreased, and the modulation factor x must increase to provide the same variation in the feedback current $I_{FBK}$ that is required to null the $\Delta V_{BE}$. In turn, this raises the variation in the output $I_{LOG}$ These intercept and slope adjustments could alternatively be applied to the ZTAT half-cell, i.e., to transistors QC,QD and QM3,QM4. However, any changes in the current density ratio in the current-sourcing transistors due to trimming will introduce undesirable PTAT drifts in the slope and intercept.

In a preferred embodiment, current mirrors QM1,QM2 and QM3,QM4 in FIGS. 17 and 20 are preferably implemented as low drop-out mirrors such as those described in U.S. Pat. No. 6,437,630 by the same inventor as the present application. The use of these specialized current mirrors allows their collectors to swing closer to ground. They also eliminate errors associated with the finite Early voltages of QA–QD, whose collectors now operate at almost the same voltage, differing only by the offset at the inputs of the low drop-out mirror.

Numerous inventive principles have been described above, and each has independent utility. In some cases, additional benefits are realized when the principles are utilized in various combinations with one another.

Some of the embodiments disclosed in this patent application have been described with specific signals implemented as current-mode or voltage mode signals, but the inventive principles also contemplate other types of signals, whether characterized as voltages or currents. Likewise, some semiconductor devices are described as being specifically NPN or PNP BJTs, but in many cases different polarities or different device types such as J-FETs or CMOS transistors can also be utilized.

A device referred to as a "log transistor" discussed herein has been shown as a bipolar junction transistor (BJT) because these are particularly well suited for use in logarithmic circuits, offering very close law conformance over a range of at least eight decades of current. However, the inventive principles of this application are not necessarily limited to log transistors. Therefore, the term "log transistor" as used herein means not only a BJT, but any type of log-responding device such as might be possible with MOS transistors operated in the sub-threshold region. This may, for example, be necessary when BJTs are not available in an integrated circuit process, and operation over only a smaller current range is required.

The "base" of a log transistor therefore refers to the control terminal of any translinear device, the "collector" refers to the terminal to which the input current is applied, and the "emitter" refers to the terminal that is grounded as that term is understood within the context of the present application. A translinear device is one exhibiting an essentially exponential relationship between the current in its output terminal and the voltage applied to its control terminal, so called because its transconductance is a linear function of the current in its output terminal. This term was introduced by the inventor of this application, and has since become widely used throughout the industry.

Thus, the embodiments described herein can be modified in arrangement and detail without departing from the inventive concepts. Accordingly, such changes and modifications are considered to fall within the scope of the following claims.

The invention claimed is:

1. A logarithmic circuit comprising:

a log transistor having a collector, a base and an emitter, wherein the collector is arranged to receive an input current;

a differential-input amplifier having a first input terminal coupled to the collector of the log transistor, a second input terminal coupled to a reference signal, and an output terminal coupled to the base of the log transistor; and a reference cell comprising:

a second log transistor having a collector, a base and an emitter, wherein the collector is arranged to receive a second input current; and a second amplifier having an input terminal coupled to the collector of the second transistor and an output terminal coupled to the base of the second transistor.

2. A circuit according to claim 1 wherein the second amplifier comprises a second differential-input amplifier having a second input terminal coupled to the reference signal.

3. A circuit according to claim 1 further comprising a temperature compensation circuit coupled to the bases of both log transistors.

4. A circuit according to claim 1, wherein the first and the second log transistors are arranged to generate a $\Delta V_{BE}$, and further comprising:

a resistor coupled between the bases of the first and second log transistors; and a feedback circuit arranged to drive the resistor with a feedback current so as to force the $\Delta V_{BE}$ to appear across the resistor.

5. A circuit according to claim 4 wherein the feedback circuit comprises:

a high-gain differential-input amplifier having a pair of input terminals coupled between one of the log transistors and the resistor; and a multiplier coupled between an output of the operational amplifier and the resistor.

6. A circuit according to claim 5 wherein the analog multiplier comprises:

a first multiplier half-cell arranged to receive a temperature stable input signal; and a second multiplier half-cell arranged to receive a PTAT input signal.

7. A circuit according to claim 4 wherein the resistor comprises two resistor halves coupled between the first and second log transistors.

8. A circuit according to claim 7 wherein the feedback circuit comprises:

a high-gain differential-input amplifier having a pair of input terminals coupled between the two resistor halves; and a multiplier coupled between an output of the operational amplifier and the two resistor halves.

9. A logarithmic circuit comprising:

a log transistor having a collector, a base and an emitter, wherein the collector is arranged to receive an input current;

a differential-input amplifier having a first input terminal coupled to the collector of the log transistor, a second input terminal coupled to a reference signal, and an output terminal coupled to the base of the log transistor; and an adaptive biasing circuit coupled to the log transistor and comprising a mirror transistor coupled to the log transistor and arranged to replicate the input current.

10. A circuit according to claim 9 wherein the adaptive biasing circuit further comprises a transresistance stage coupled to mirror transistor.

11. A logarithmic circuit comprising:

a log transistor having a collector, a base and an emitter, wherein the collector is arranged to receive an input current;

a differential-input amplifier having a first input terminal coupled to the collector of the log transistor, a second input terminal coupled to a reference signal, and an output terminal coupled to the base of the log transistor;

a second log transistor having a base coupled to the base of the first log transistor; and a resistor coupled between the base of the first log transistor and the collector of the second transistor.

12. A method for operating a log transistor having a base, an emitter and a collector comprising:

applying an input current to the collector;

maintaining the emitter at a ground reference;

driving the base responsive to the collector voltage and a reference signal;

maintaining the emitter of a second log transistor at a ground reference; and driving the base of the second log transistor responsive to the voltage of the collector of the second log transistor and the reference signal.

13. A method according to claim 12 wherein the input current is applied to the collector through a resistor.

14. A method according to claim 12 further comprising generating a temperature compensated logarithmic output signal responsive to the relative base-emitter voltages of the first and second log transistors.

15. A method according to claim 14 further comprising trimming the temperature compensated output signal by supplying an additive signal to the output signal.

16. A method according to claim 14 wherein generating the temperature compensated output signal comprises:

operating a multiplier having a differential output; and adding an imbalance to the differential output.

17. A method according to claim 14 wherein generating the temperature compensated output signal comprises:

operating a multiplier; and augmenting the multiplier with cross-connected signals.

18. A method according to claim 12 further comprising:

generating a $\Delta V_{BE}$ between first and second log transistors; and forcing the $\Delta V_{BE}$ to appear across a resistor coupled between the bases of the first and second log transistors.

19. A method according to claim 18 wherein forcing the $\Delta V_{BE}$ to appear across the resistor comprises:

generating an intermediate signal responsive to the difference between the $\Delta V_{BE}$ and the voltage across the resistor; and multiplying the intermediate signal by PTAT signal and a temperature stable signal.

20. A method for operating a log transistor having a base, an emitter and a collector comprising:

applying an input current to the collector;

maintaining the emitter at a ground reference;

driving the base responsive to the collector voltage and a reference signal; and generating an adaptive bias signal responsive to the input current;

wherein generating the adaptive bias signal comprises replicating the input current.

21. A method for operating a log transistor having a base, an emitter and a collector comprising:

applying an input current to the collector;

maintaining the emitter at a ground reference;

driving the base responsive to the collector voltage and a reference signal;

generating a compensation voltage equal to the emitter resistance voltage of the log transistor; and subtracting the compensation voltage from the output of the log transistor.

22. A method according to claim 21 wherein generating and subtracting the compensation voltage comprises:

operating the log transistor and a second log transistor at the same base-emitter voltage; and generating the compensation voltage across a resistor coupled between the base and collector of the second log transistor.

23. A logarithmic circuit comprising:

a log transistor having a collector, a base and an emitter, wherein the collector is arranged to receive an input current; and a differential-input amplifier having a first input terminal coupled to the collector of the log transistor, a second input terminal coupled to a reference signal, and an output terminal coupled to the base of the log transistor;

wherein the emitter of the log transistor is grounded.

24. A method for operating a log transistor having a base, an emitter and a collector comprising:

applying an input current to the collector;

maintaining the emitter at a ground reference; and driving the base responsive to the collector voltage and a reference signal;

wherein maintaining the emitter at a ground reference comprises connecting the emitter directly to a ground.

* * * * *

UNITED STATES PATENT AND TRADEMARK OFFICE

CERTIFICATE OF CORRECTION

PATENT NO. : 7,310,656 B1
APPLICATION NO. : 10/316990
DATED : December 18, 2007
INVENTOR(S) : Barrie Gilbert It is certified that error appears in the above-identified patent and that said Letters Patent is hereby corrected as shown below:

Column 6, line 63, the word "$R_{PD}$=5Ω" should read -- $R_{PD}$=5kΩ --;

Column 9, line 65, the word "$R_L$" should read -- $R_{L1}$ --;

Column 11, line 23, the words "to log" should read -- to BJT log --.

Signed and Sealed this

Eighteenth Day of August, 2009

David J. Kappos

David J. Kappos
*Director of the United States Patent and Trademark Office*